US010433598B2

(12) United States Patent
Maqbool

(10) Patent No.: US 10,433,598 B2
(45) Date of Patent: Oct. 8, 2019

(54) LINER WITH ACCESS MEANS

(71) Applicant: Shaf International, Garfield, NJ (US)

(72) Inventor: Mohammad Maqbool, Garfield, NJ (US)

(73) Assignee: Shaf International, Inc., Wayne, NJ (US)

( * ) Notice: Subject to any disclaimer, the term of this patent is extended or adjusted under 35 U.S.C. 154(b) by 63 days.

(21) Appl. No.: 15/643,249

(22) Filed: Jul. 6, 2017

(65) Prior Publication Data

US 2017/0303610 A1 Oct. 26, 2017

Related U.S. Application Data

(60) Provisional application No. 62/448,169, filed on Jan. 19, 2017.

(51) Int. Cl.

| | |
|---|---|
| ***A41D 27/02*** | (2006.01) |
| ***A41D 27/20*** | (2006.01) |
| ***A41D 1/04*** | (2006.01) |

(52) U.S. Cl.

CPC ..... *A41D 27/02* (2013.01); *A41D 1/04* (2013.01); *A41D 27/20* (2013.01); *A41D 2300/32* (2013.01); *A41D 2300/322* (2013.01); *A41D 2300/324* (2013.01)

(58) Field of Classification Search

CPC ..... A41D 27/02; A41D 27/04; A41D 27/201; A41D 27/20; A41D 13/0012; A41D 1/04; A41D 1/02; A41D 1/18; A41D 2300/30; A41D 2300/32; A41D 2300/322; A41D 2300/324; A41D 27/08

USPC ..... 2/94, 103, 97

See application file for complete search history.

(56) References Cited

U.S. PATENT DOCUMENTS

| | | | | | |
|---|---|---|---|---|---|
| 1,195,738 | A | * | 8/1916 | Rose | A41D 27/02 2/97 |
| 1,358,387 | A | * | 11/1920 | Nead | A41D 27/04 2/85 |
| 1,723,214 | A | * | 8/1929 | Smith | A41D 13/0012 2/94 |
| 2,069,579 | A | * | 2/1937 | Epstein | A41D 1/02 2/128 |
| 2,073,230 | A | * | 3/1937 | Siegel | A41D 27/04 2/97 |
| 2,305,499 | A | * | 12/1942 | Shane | A41D 27/04 2/97 |

(Continued)

OTHER PUBLICATIONS

First Manufacturing Co., First Mfg—Easy Acess Panels, https://www.youtube.com/watch?v=ZVADe7dW1TA&feature=youtu.be, May 22, 2017, Youtube.com.

*Primary Examiner* — Amy Vanatta

(74) *Attorney, Agent, or Firm* — John H. Choi & Associates

(57) ABSTRACT

A garment or accessory includes an outer layer coupled to a liner that is partially removable via fasteners. The outer layer includes an inner surface and an outer surface. The liner includes an edge. A portion of the edge is coupled to the inner surface of the outer layer. The fastener includes a first member coupled to the inner surface of the outer layer and a second member coupled to the liner at an uncoupled portion of the edge of the liner. A space is formed between the liner and the inner surface of the outer layer. The space is accessible through the uncoupled portion.

18 Claims, 6 Drawing Sheets

(56) References Cited

U.S. PATENT DOCUMENTS

| | | | | | |
|---|---|---|---|---|---|
| 2,678,447 | A * | 5/1954 | Bracken | A41D 13/0012 | 2/94 |
| 3,514,788 | A * | 6/1970 | Miller | A41D 13/00 | 2/50 |
| 3,529,307 | A * | 9/1970 | Belson | A41D 13/0012 | 2/94 |
| 3,950,789 | A * | 4/1976 | Konz | A41D 13/0055 | 2/93 |
| 4,700,409 | A * | 10/1987 | De Lott | A45F 4/12 | 2/102 |
| 5,002,270 | A * | 3/1991 | Shine | A63B 21/065 | 2/102 |
| 5,195,187 | A * | 3/1993 | Yang | A41D 13/0012 | 2/102 |
| 5,570,473 | A * | 11/1996 | Andries | A41D 3/00 | 2/108 |
| 6,199,210 | B1 * | 3/2001 | Feldman | A41D 3/00 | 2/108 |
| 7,743,430 | B2 * | 6/2010 | Jennings | A45C 1/04 | 2/94 |
| 2004/0172734 | A1 * | 9/2004 | Hartbrodt | A41D 13/0012 | 2/97 |

* cited by examiner

LINER WITH ACCESS MEANS

CROSS-REFERENCE TO RELATED APPLICATION

This application claims priority to U.S. Provisional Patent Application No. 62/448,169 filed Jan. 19, 2017, which is incorporated by reference.

FIELD OF INVENTION

The present invention relates to apparel, more specifically, to a liner with access means to an outer fabric of an item for embroidering and other customized work.

BACKGROUND OF THE INVENTION

Individuality is an essential characteristic of modern dress, for both the young and the old, and for females and males. However, it is both costly and difficult to purchase or make custom-styled garments. Thus, there is great need for means for individualizing otherwise undistinguished, mass produced garments.

One form of individualizing apparel is by embroidering custom designs or attaching patches to apparel. These designs and patches are often used by persons to express an affiliation with or support for a particular cause. For example, a motorcycle club may have a common design or patch that each member desires or is required to attach to her jacket or other apparel to show affiliation. The member may also desire to remove the design or patch when he or she changes affiliation, instead of purchasing a new jacket or other apparel especially if the jacket or other apparel is expensive.

While distinctive decorative embroidery and patches may be hand or machine sewn to garments, they require both considerable skill and time for application. This is because most garments are produced with a liner. Liners are generally a non-irritable material than an outer material of a garment, and provide a wearer with a softer contact surface and may also block wind from making contact with the wearer. Thus, liners are essential to a garment or apparel, especially jackets and vests.

For jackets and vests, an enclosed liner is provided on an inner portion of the garment also to conceal stitching resulting from embroidery or patches and to cover excess fabric backing and stitching on an inner surface of the outer material of the garment. In the prior art, a technician must remove the liner by cutting liner, commonly along the edges or seams of the liner, prior to performing stitching of embroidery and patches, and after work is performed the technician must then reattach the liner to the garment. As a result, much time and labor is required which results in high cost.

Similarly, once stitched to the garment, the embroidery or patch becomes, for all practicable purposes, an integral part of the garment, and it is difficult to remove without much time and effort. Again, the liner must be removed by cutting the edges prior to removing the embroidery or patch and then reattached after removal of the embroidery or patch. Thus, it is labor intensive and again results in high cost.

Therefore, a need exists for reducing the time and effort required to apply and remove custom embroidery and patches to and from apparel.

SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The present invention solves the problems associated with prior art methods of applying embroidery and patches to a garment, apparel, or accessory discussed above and also provides additional advantages which are set forth in more detail below.

In general, the present invention provides a means for easily accessing an outer portion of a garment, apparel, or accessory for applying and removing embroidery, patches and the like thereto. More specifically, the present invention includes a partially removable liner in a garment, apparel, or accessory. The liner includes at least one closable opening such that a technician can easily access the outer material of the garment without having to cut the liner and reattach the same.

In one aspect, the present invention provides a garment or accessory, comprising: an outer layer having an inner surface and an outer surface; a liner, having an edge, a portion of said edge coupled to said inner surface; a fastener, having a first member coupled to said inner surface and a second member coupled to said liner at an uncoupled portion of said edge; wherein a space is formed between said liner and said inner surface; and wherein said space is accessible through said uncoupled portion.

In another aspect, the present invention provides a garment or accessory, comprising: an outer layer having an inner surface and an outer surface; a liner having an opening, the liner being coupled to the outer layer, a space formed between the outer layer and the liner, the space being accessible through the opening; and a fastener operably coupled to the liner such that the opening is closable.

In yet another aspect, the present invention provides a garment or accessory, comprising: an outer layer having a first inner surface and an opposing first outer surface; an inner layer having a second inner surface and an opposing second outer surface, the inner and outer layers at least partially coupled together permanently along a first perimeter, a space formed between the inner and outer layers within the first perimeter, and an opening formed on the inner layer such that the space is accessible.

BRIEF DESCRIPTION OF THE SEVERAL VIEWS OF DRAWINGS

The foregoing summary, as well as the following detailed description of presently preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

Figure 1:
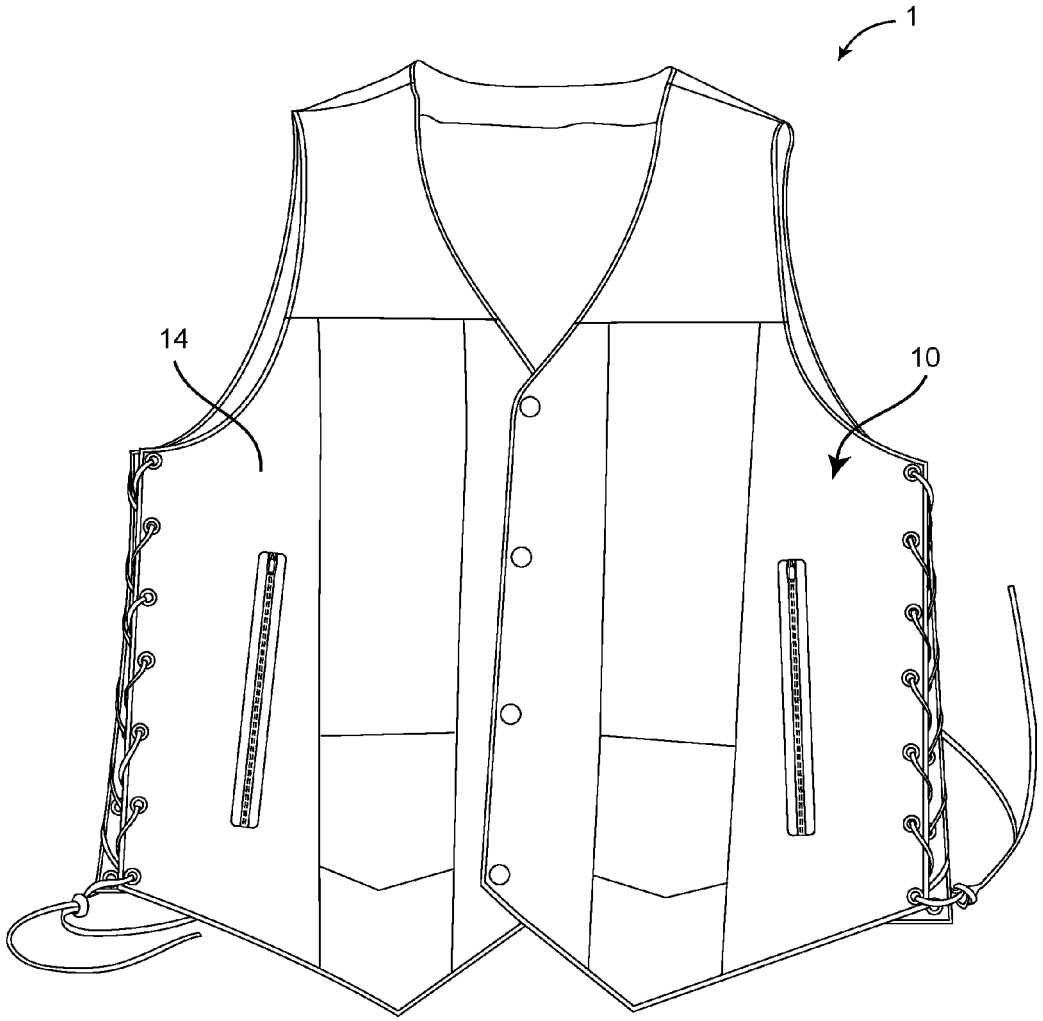
FIG. 1 is a front view of an embodiment of a garment or accessory of the present invention, namely, a vest, showing an outer surface of an outer layer.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION OF THE INVENTION

Certain terminology is used in the following description for convenience only and is not limiting. The article "a" is intended to include one or more items, and where only one item is intended the term "one" or similar language is used. Additionally, to assist in the description of the present invention, words such as top, bottom, side, upper, lower, front, rear, inner, outer, right and left are used to describe the accompanying figures. The terminology includes the words above specifically mentioned, derivatives thereof, and words of similar import.

Referring to the figures, a garment 1 of the present invention is shown. In this embodiment, the garment is a vest but the present invention could be applied to other garments with liners such as but not limited to jackets, shirts, blouses, pants and shorts. The present invention could also be utilized in other accessories such as handbags, purses and wallets.

Figure 2:
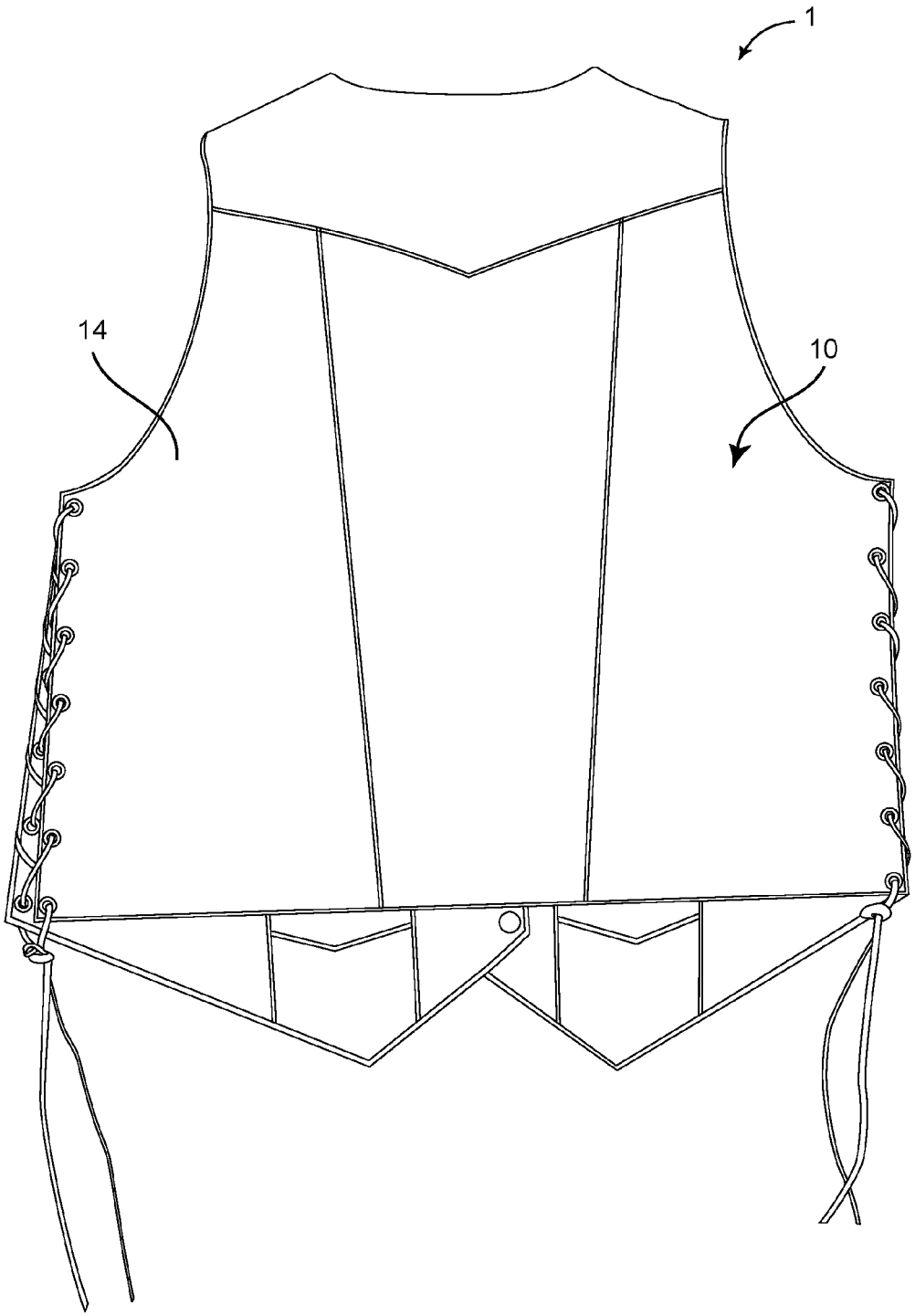
FIG. 2 is a rear view of the vest of FIG. 1, showing an outer surface of an outer layer.
Figure 3:
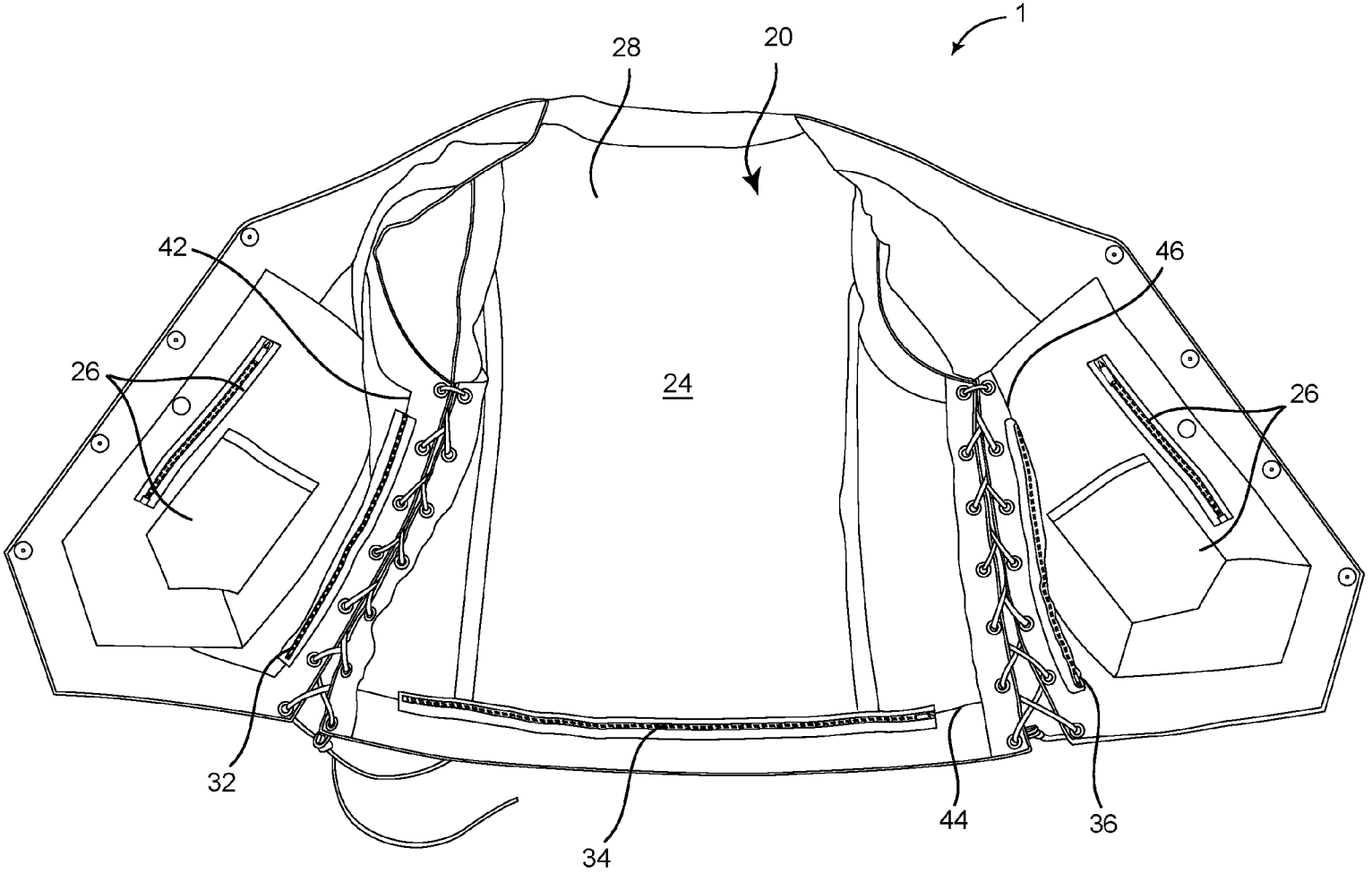
FIG. 3 is a front view of the vest of FIG. 1, showing an inner surface with fasteners in closed configurations.
Figure 4:
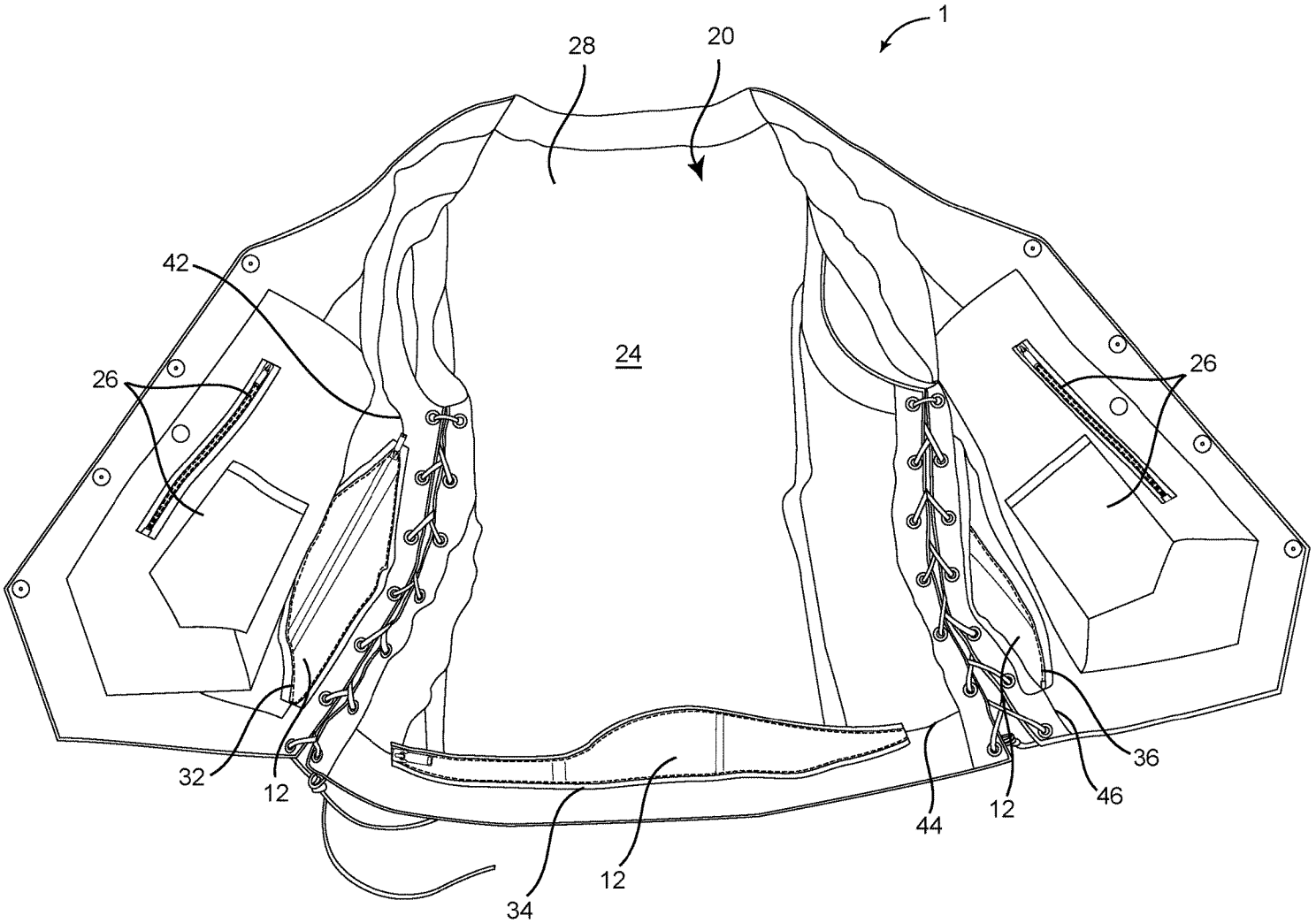
FIG. 4 is a front view of the vest of FIG. 1, showing an inner surface with fasteners in open configurations.
Figure 5:
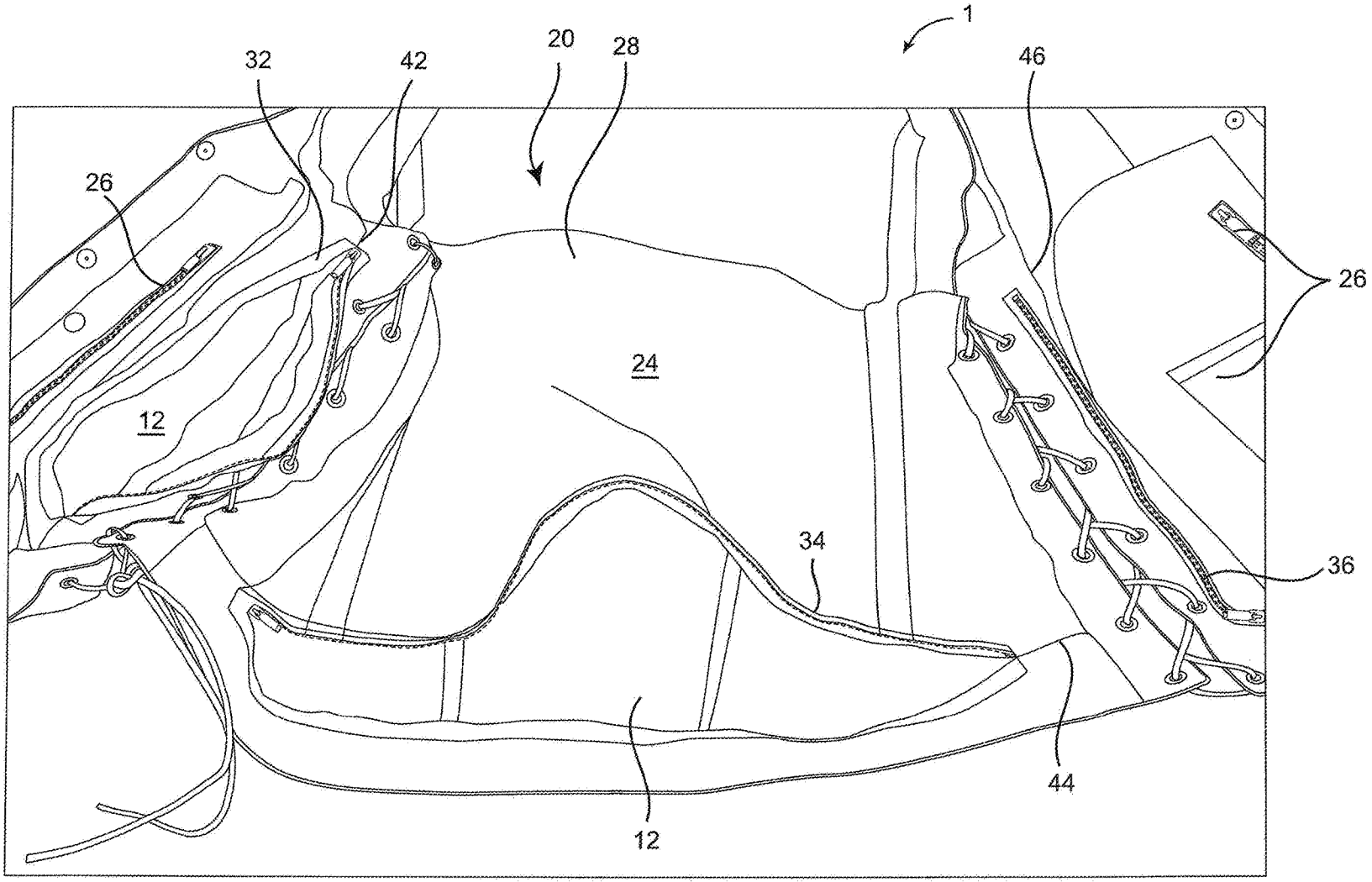
FIG. 5 is a perspective view of the vest of FIG. 1, showing an inner surface with a side fastener and a bottom fastener in open configurations.
Figure 6:
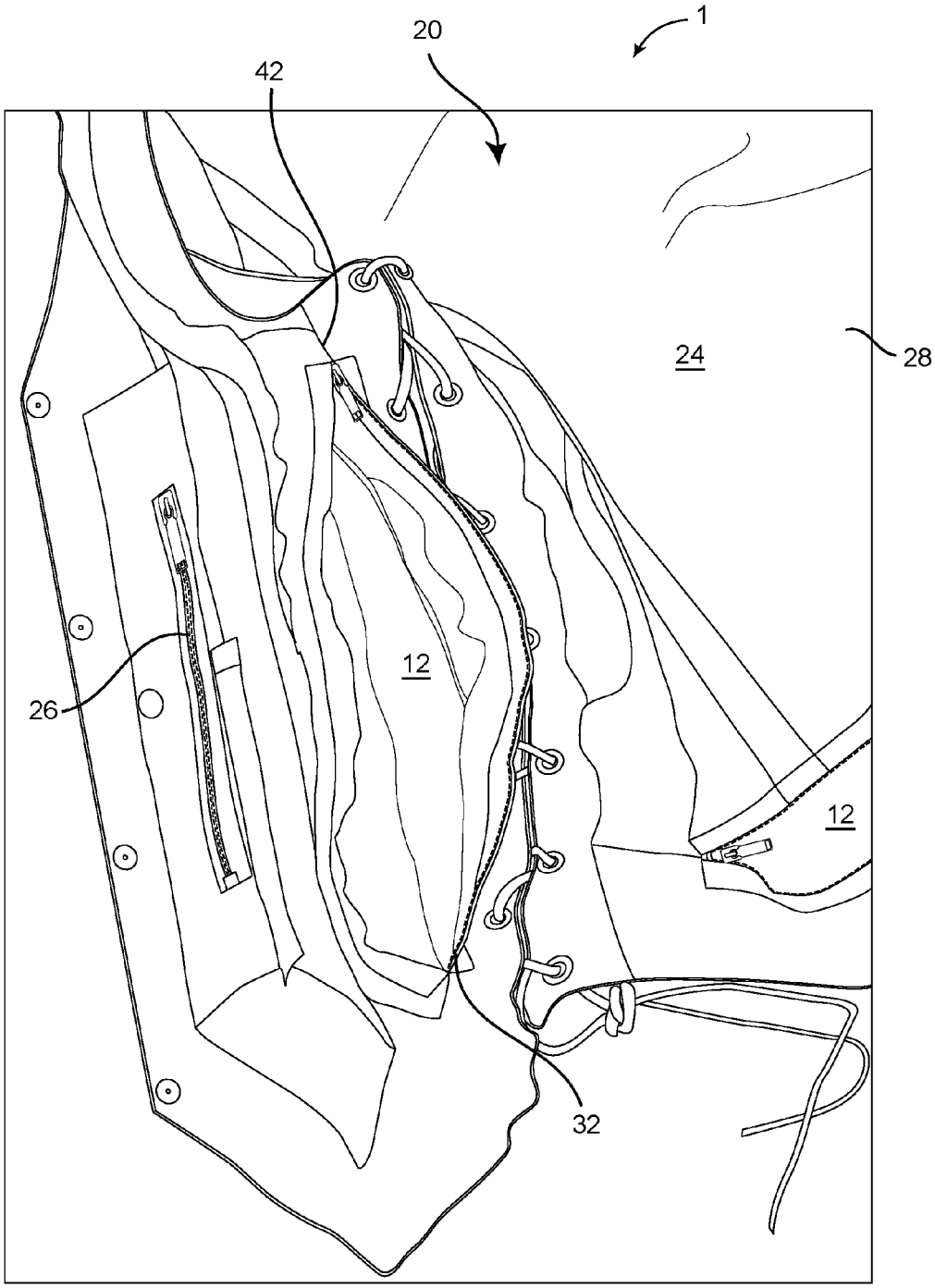
FIG. 6 is a perspective view of the vest of FIG. 1, showing an inner surface with a side fastener in an open configuration.

Referring to FIGS. 1 and 2, an outer layer 10 of the garment 1 is shown. The outer layer 10 could be of materials such as leather, faux leather, cotton, polyester, nylon, etc. or any combination thereof and could be constructed by attaching a plurality of fabric portions. In this embodiment, the outer layer 10 of the vest 1 is constructed of multiple pieces of leather.

Referring to FIGS. 3-6, an inner layer or liner 20 of the garment 1 is shown. The liner 20 includes an inner surface (not shown) and an outer surface 24, and is generally attached to the outer layer 10 of the garment along outer seams. The inner portion or liner 20 could be of materials such as cotton, polyester, nylon or any combination thereof. In general, the liner 20 is a more non-irritable material than the material of the outer layer 10 of the garment 1, and provides a wearer with a softer contact surface (outer surface 24 of the liner 20) and may also block or reduce wind or air from penetrating the outer layer 10 and making contact with the wearer. The liner 20 could also be used to construct pockets and the like 26. In addition, the liner 20 is used to conceal the inner construction or an inner surface 12 of the outer layer 10, specifically, excess fabric and stitching of the outer layer 10.

As described above, when the wearer desires embroidery on a garment 1, the liner 20 must be removed because the technician must have access to both the inner surface 12 and an outer surface 14 of the outer layer 10 of the garment 1. In the prior art, the liner is at least partially removed by cutting the edges of the liner along the seams or removing stitching along the edges of the liner prior to gaining access to the inner surface 12 of the outer layer 10 for embroidering and attaching other items such as patches. Subsequent to performing the embroidery, the liner is then stitched back onto the inner surface of the outer portion of the garment. A similar process is performed to remove embroidery or other decorative item from the garment. This process is very time consuming and labor intensive, and therefore quite costly.

Referring to FIGS. 3-6, the present invention provides a convenient means for a technician to have access to the inner surface 12 of the outer layer 10 of the garment 1. Specifically, a plurality of closable accesses 32, 34, 36 are provided along seams 42, 44, 46 of the liner 20. In this embodiment, a lower closable access 34 is positioned along a lower seam 44 of the garment 1 and is 17 inches in length. The side closable accesses 32, 36 are positioned along side seams 42, 46 of the garment 1 and are 9 inches in length. The remaining portions of the seams 42, 44, 46 remain stitched to the outer layer 10 of the garment 1. In this embodiment, each closable access 32, 34, 36 is a conventional zipper configured to be quickly opened and closed as desired by the technician. However, each closable access 32, 34, 36 could take on other forms of fasteners including but not limited to button and hole combinations, hook and loop fasteners (e.g., Velcro) and snap buttons having male and female engagements.

In other embodiments, the closable accesses 32, 34, 36 could be located on other parts of the liner 20. For example, the lower closable access 34 could be positioned across a back liner 28 at a mid-portion thereof. Moreover, each closable access 32, 34, 36 could be of different lengths and sizes and more or fewer closeable accesses could be provided.

In another embodiment, multiple liners can be provided. For example, a liner with a pocket can be coupled to a base liner.

The closable accesses 32, 34, 36 in the present invention provide a convenient means for a technician to quickly open the accesses when needed and also quickly close the accesses upon completion of a job. Instead of having to cut the liner 20 to gain access to the inner surface 12 of the outer layer 10, a technician can have immediate access to the inner surface 12, thus reducing time and labor, and ultimately reducing cost to perform work on the garment 1.

The closable accesses 32, 34, 36 also provide the technician the ability to place the outer layer 10 of the garment 1 directly on a working surface such as a sewing machine to embroider or sew items onto the outer layer 10. Such work could include embroidering, attaching patches and other customized materials and accessories to the garment 1.

The present invention may be embodied in other specific forms without departing from its spirit or essential characteristics. The described embodiments are to be considered in all respects only as illustrative and not restrictive. The scope of the invention will be, therefore, indicated by the claims below rather than by the foregoing description. All changes which come within the meaning and range of equivalency of the claims are to be embraced within their scope.

The invention claimed is:

1. A garment or accessory, comprising:

an outer layer having a back portion with an inner surface and an outer surface;

a liner positioned on the outer layer back portion, the liner having a first perimeter being a substantially outermost extent of the back portion, a portion of said first perimeter coupled to said inner surface, the liner and the outer layer at least partially coupled together permanently along the first perimeter;

a fastener, having a first member coupled to said inner surface and a second member coupled to said liner at an uncoupled portion of said first perimeter, with the fastener having a closed state when the first member engages the second member, and the fastener having an open state when the first member is disengaged from the second member;

a space formed between said liner and said inner surface within the first perimeter, wherein the space is completely enclosed when the fastener is in the closed state; and an opening formed on the first perimeter when the fastener is in the open state, wherein the opening is positioned on the uncoupled portion between the liner and the outer layer;

wherein said space is accessible through said uncoupled portion.

2. The garment or accessory of claim 1, wherein said outer layer includes a seam, said first member positioned on the seam.

3. The garment or accessory of claim 1, wherein said liner is coupled to said inner surface by means of stitching.

4. The garment or accessory of claim 1, wherein the garment or accessory is a vest.

5. The garment or accessory of claim 1, wherein said fastener is selected from the group consisting of a zipper, a snap button, a button and buttonhole combination, and a hook and loop fastener.

6. The garment or accessory of claim 1, wherein said outer layer is constructed of a material selected from the group consisting of leather, faux leather, cotton, wool, and synthetic fabric.

7. The garment or accessory of claim 1, wherein said outer layer comprises a plurality of sections.

8. The garment or accessory of claim 1, wherein said liner further comprises a pocket.

9. The garment or accessory of claim 8, wherein the pocket is secured to an outer surface of the liner.

10. The garment or accessory of claim 1, wherein the opening is positioned at a bottom portion of the liner.

11. A garment or accessory, comprising:

an outer layer having a back portion with an inner surface and an outer surface;

a liner positioned on the outer layer back portion, the liner having a first perimeter being a substantially outermost extent of the back portion, and an opening formed on the first perimeter, the liner being at least partially coupled to the outer layer permanently along the first perimeter, wherein the opening is positioned on an uncoupled portion between the liner and the outer layer, and with a space formed between the outer layer and the liner within the first perimeter, the space being accessible through the opening; and a fastener having a first member and a second member, with the fastener having a closed state when the first member engages the second member, and the fastener having an open state when the first member is disengaged from the second member, with the fastener operably coupled to the liner such that the opening is closable in the closed state of the fastener to completely enclose the space, and the opening is open in the open state of the fastener.

12. The garment or accessory of claim 11, wherein the fastener is selected from the group consisting of a zipper, a snap button, a button and buttonhole combination, and a hook and loop fastener.

13. The garment or accessory of claim 11, wherein the fastener first member is secured on the liner and the fastener second member is secured on the outer layer.

14. The garment or accessory of claim 11, wherein the fastener first and second members are secured on the liner.

15. The garment or accessory of claim 11, wherein the opening is positioned at a bottom portion of the liner.

16. A garment or accessory, comprising:

an outer layer having a back portion with a first inner surface and an opposing first outer surface;

an inner layer having a second inner surface, an opposing second outer surface, and a first perimeter being a substantially outermost extent of the back portion, the inner and outer layers at least partially coupled together permanently along the first perimeter, a space formed between the inner and outer layers within the first perimeter;

a fastener having a first member and a second member, with the fastener having a closed state when the first member engages the second member, with the space being completely enclosed when the fastener is in the closed state, and the fastener having an open state when the first member is disengaged from the second member; and an opening formed on the first perimeter when the fastener is in the open state, wherein the opening is positioned on an uncoupled portion between the inner and outer layers.

17. The garment or accessory of claim 16, the fastener being positioned on the opening such that the opening is closable.

18. The garment or accessory of claim 16, wherein the opening is positioned at a bottom portion of the inner layer.

* * * * *